US009241219B2

(12) United States Patent
Chen et al.

(10) Patent No.: US 9,241,219 B2
(45) Date of Patent: Jan. 19, 2016

(54) AUDIO DEVICE AND PORTABLE ELECTRONIC DEVICE

(71) Applicant: Chiun Mai Communication Systems, Inc., New Taipei (TW)

(72) Inventors: Wei-Rung Chen, New Taipei (TW); Kai-Lun Yu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 166 days.

(21) Appl. No.: 14/055,950

(22) Filed: Oct. 17, 2013

(65) Prior Publication Data

US 2014/0369540 A1 Dec. 18, 2014

(30) Foreign Application Priority Data

Jun. 13, 2013 (TW) ..... 102120844 A

(51) Int. Cl.
*H04R 5/04* (2006.01)

(52) U.S. Cl.
CPC ..... *H04R 5/04* (2013.01)

(58) Field of Classification Search
USPC ..... 381/334
See application file for complete search history.

(56) References Cited

U.S. PATENT DOCUMENTS

| | | | | |
|---|---|---|---|---|
| 7,457,423 | B2 * | 11/2008 | Lazzeroni et al. | 381/86 |
| 7,505,600 | B2 * | 3/2009 | Dryer | 381/111 |
| 2006/0029235 | A1 * | 2/2006 | Lazzeroni et al. | 381/86 |
| 2013/0044900 | A1 * | 2/2013 | Chen et al. | 381/121 |

* cited by examiner

*Primary Examiner* — Mark Blouin
(74) *Attorney, Agent, or Firm* — Novak Druce Connolly Bove + Quigg LLP

(57) ABSTRACT

A portable electronic device includes a built-in speaker, an interface configured to connect to an external audio device to output sound, a switch, and a main microchip. The main microchip detects whether the external audio device is connected to the portable electronic device. When the external audio device is connected to the portable electronic device, the main microchip selects the audio device to output sound. When the audio device is not connected to the portable electronic device, the main microchip selects the built-in speaker to output the audio signals.

8 Claims, 4 Drawing Sheets

AUDIO DEVICE AND PORTABLE ELECTRONIC DEVICE

BACKGROUND

1. Technical Field

The disclosure generally relates to audio devices, and particularly to an audio device used by a portable electronic device.

2. Description of Related Art

A portable electronic device, such as a mobile phone, commonly includes a built-in speaker to output audio. However, sound volume and quality of the built-in speaker usually is usually insufficient so that an external audio device such as a loudspeaker may be connected to the portable electronic device and output the sound with an increased sound volume and higher sound quality. The external audio device generally has a complex structure which may include a speaker, an amplifier circuit and a power source. Thus, the external audio device is commonly heavy and bulky and inconvenient for the user to carry.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
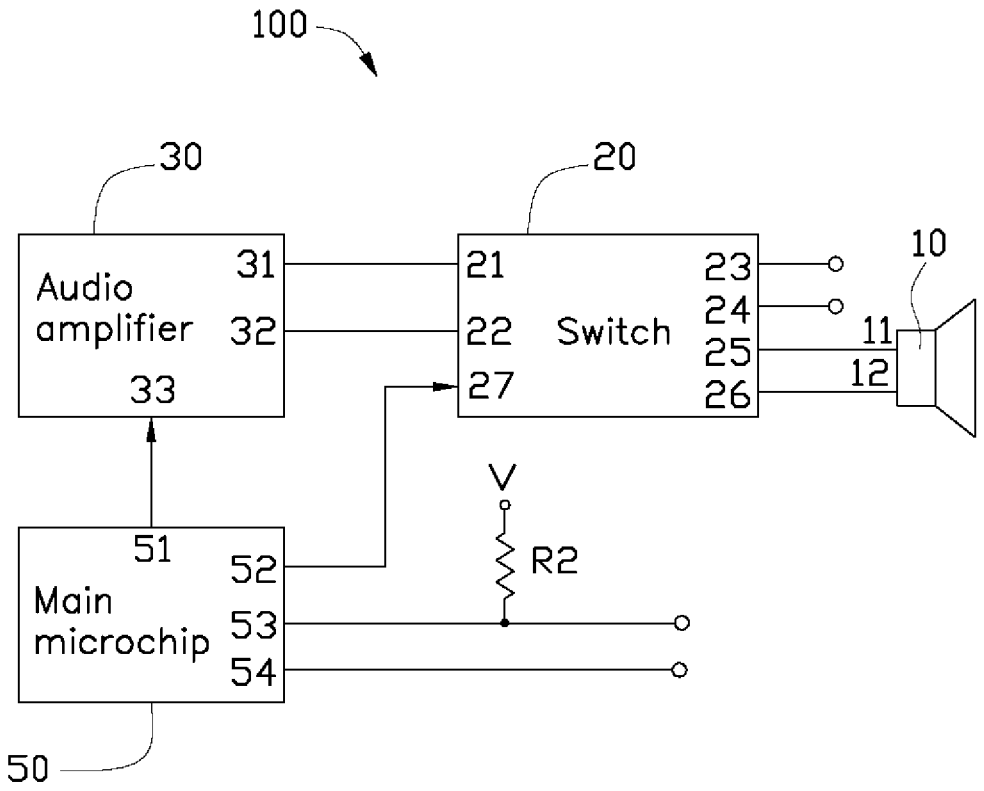
FIG. 1 is block diagram of a portable electronic device, according to an exemplary embodiment of the disclosure.
Figure 2:
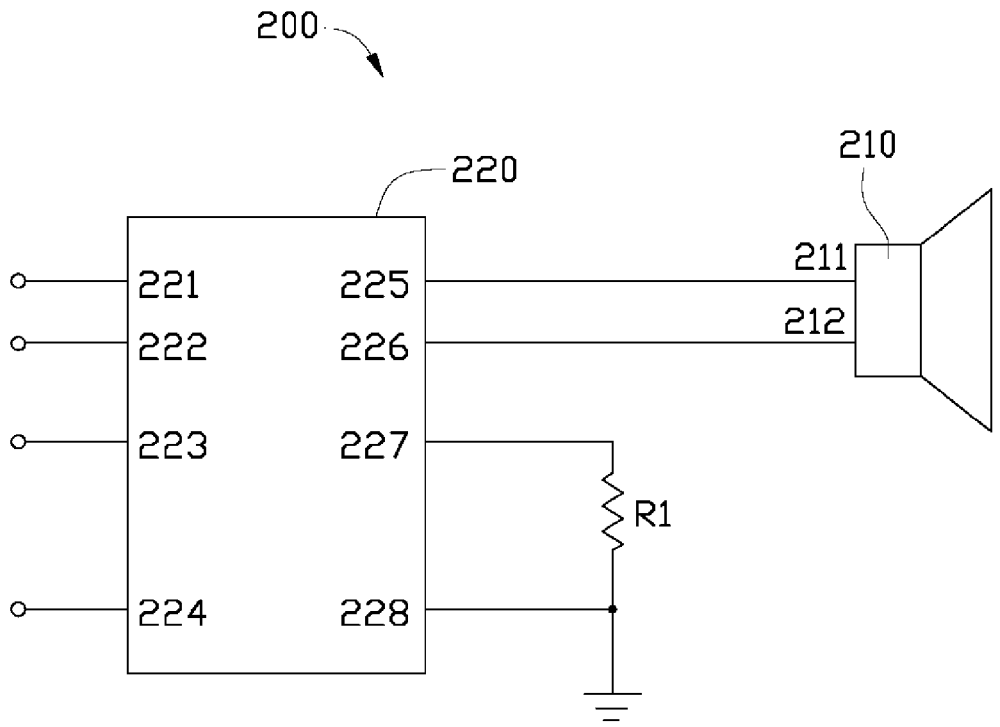
FIG. 2 is block diagram of an audio device, according to an exemplary embodiment of the disclosure.

FIG. 1 is block diagram of a portable electronic device 100, according to an exemplary embodiment of the disclosure. The portable electronic device 100 may be a mobile phone, a personal digital assistant, for example. Also referring to FIG. 2, the portable electronic device 100 can be connected to an audio device 200 to output audio signals.

The audio device 200 includes an external speaker 210 and a connector 220. The external speaker 210 is configured to output the audio signals for the portable electronic device 100. The external speaker 210 includes a left channel 211 and a right channel 212 which can be connected to the portable electronic device 100 by the connector 220. The connector 220 includes a first input terminal 221, a second input terminal 222, a third input terminal 223, a fourth input terminal 224, a first output terminal 225, a second output terminal 226, a third output terminal 227 and a fourth output terminal 228. The first, second, third, and fourth output terminals 225, 226, 227, 228 are respectively connected to the first, second, third, and fourth input terminals 221, 222, 223, 224. The first, second, third, and fourth input terminals 221, 222, 223, 224 are configured to connect to the portable electronic device 100. The first and second output terminals 225, 226 are electronically connected to the left channel 211 and the right channel 212 respectively to output the audio signals from the portable electronic device 100 to the external speaker 210. The third and fourth output terminals 227, 228 are electronically connected to two ends of a first resistor R1. The fourth output terminal 228 is also grounded.

The portable electronic device 100 includes a built-in speaker 10, a switch 20, an audio amplifier 30, and a main microchip 50.

The built-in speaker 10 is mounted inside the portable electronic device 100 and configured to output the audio signals. The built-in speaker 10 includes a left channel 11 and a right channel 12.

The switch 20 includes a first common terminal 21, a second common terminal 22, a first switch terminal 23, a second switch terminal 24, a third switch terminal 25, and a fourth switch terminal 26, and a switch control terminal 27.

The first common terminal 21 and the second common terminal 22 are electronically connected to the audio amplifier 30 to receive the audio signals. The first switch terminal 23 and the second switch terminal 24 are configured to connect to the left channel 211 and the right channel 212 of the external speaker 210 when the audio device 200 is connected to the portable electronic device 100. The third switch terminal 25 and the fourth switch terminal 26 are electronically connected to the left channel 11 and the right channel 12 of the built-in speaker 10. The switch control terminal 27 is electronically connected to the main microchip 50. The first and the second common terminals 21, 22 are selectively connected to the first and second switch terminals 23,1 24 or to the third and fourth switch terminals 25, 26 under the control of the main microchip 50 so that the first and the second common terminals 21, 22 are selectively connected to either the external speaker 210 or to the built-in speaker 10.

The audio amplifier 30 is electronically connected to an audio converting circuit (not shown) to receive and amplify the audio signals from the audio converting circuit. The audio amplifier 30 includes a first output terminal 31, a second output terminal 32, and an amplifying control terminal 33. The first output terminal 31 and the second output terminal 32 are respectively electronically connected to the first input terminal 21 and the second input terminal 22 to output the amplified audio signal to the switch 20. The amplifying control terminal 33 is electronically connected the main microchip 51.

The main microchip 50 is a central processing microchip of the portable electronic device 100. The main microchip 50 includes a first control terminal 51, a second control terminal 52, a detecting terminal 53, and a ground terminal 54. The first control terminal 51 is electronically connected to the amplifying control terminal 33 to control audio signal amplitude of the audio amplifier 30. The second control terminal 52 is electronically connected to the switch control terminal 27 to switch the switch 20 from one mode to the other. The detecting terminal 53 is electronically connected to a power supply V by a second resistor R2 so that the detecting terminal 53 is at a high voltage level (i.e. logic 1).

The first switch terminal 23, the second switch terminal 24, the detecting terminal 53 and the ground terminal 54 are defined as an interface of the portable electronic device 100 to connect to the audio device 200.

When the audio device 200 is connected to the portable electronic device 100, the first switch terminal 23, the second switch terminal 24, the detecting terminal 53, and the ground terminal 54 are then connected to the first, second, third and fourth input terminals 221, 222, 223, 224 respectively so that the first switch terminal 23, the second switch terminal 24 are connected to the left channel 211 and the right channel 212 of the external speaker 210, and the detecting terminal 53 is grounded by the first resistor R1. Thus, the detecting terminal 53 is at a low voltage level. The main microchip 50 controls the first common terminal 21 and the second common terminal 22 to connect to the first switch terminal 23 and the second switch terminal 24 so that the main microchip 50 selects the external speaker 210 to output the audio signals by the switch 20.

When the audio device 200 is not connected to the portable electronic device 100, the detecting terminal 53 is at a high voltage level. The main microchip 50 controls the first common terminal 21 and the second common terminal 22 to connect to the third switch terminal 25 and the fourth switch terminal 26 so that the main microchip 50 selects the built-in speaker 10 to output the audio signals by the switch 20.

In use, when the portable electronic device 100 outputs the audio signals by the built-in speaker 10, the detecting terminal 53 is directly connected to the power supply V by the second resistor R2 so that the detecting terminal 53 is at a high voltage level. The main control microchip 50 controls the first and second common terminals 21, 22 to electronically connect to the third and fourth switch terminals 25, 26. The audio amplifier 30 amplifies the audio signals and sends the amplified audio signals to the built-in speaker 10 by the switch 20.

When the portable electronic device 100 outputs the audio signal by the audio device 200, the detecting terminal 53 is directly connected to the power supply V by the second resistor R2 so that the detecting terminal 53 is at a high voltage level. The main control microchip 50 controls the first and second common terminals 21, 22 to electronically connect to the first and second switch terminals 23, 24. The audio amplifier 30 amplifies the audio signals and sends the amplified audio signals to the external speaker 210 by the switch 20.

Therefore, the portable electronic device 100 and the audio device 200 form an audio playback assembly which is convenient for users to carry because the audio device 200 has a simple and compact structure.

Figure 3:
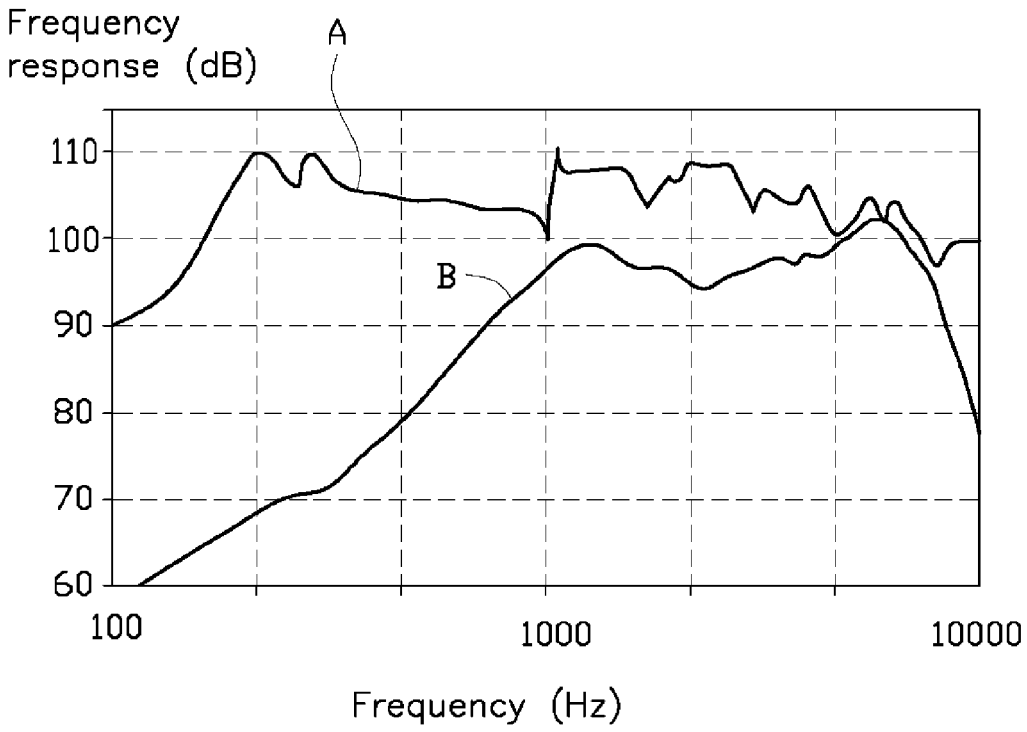
FIG. 3 is frequency response diagram of the portable electronic device of FIG. 1 using the audio device of FIG. 2 to receive audio signals, according to an exemplary embodiment of the disclosure.
Figure 4:
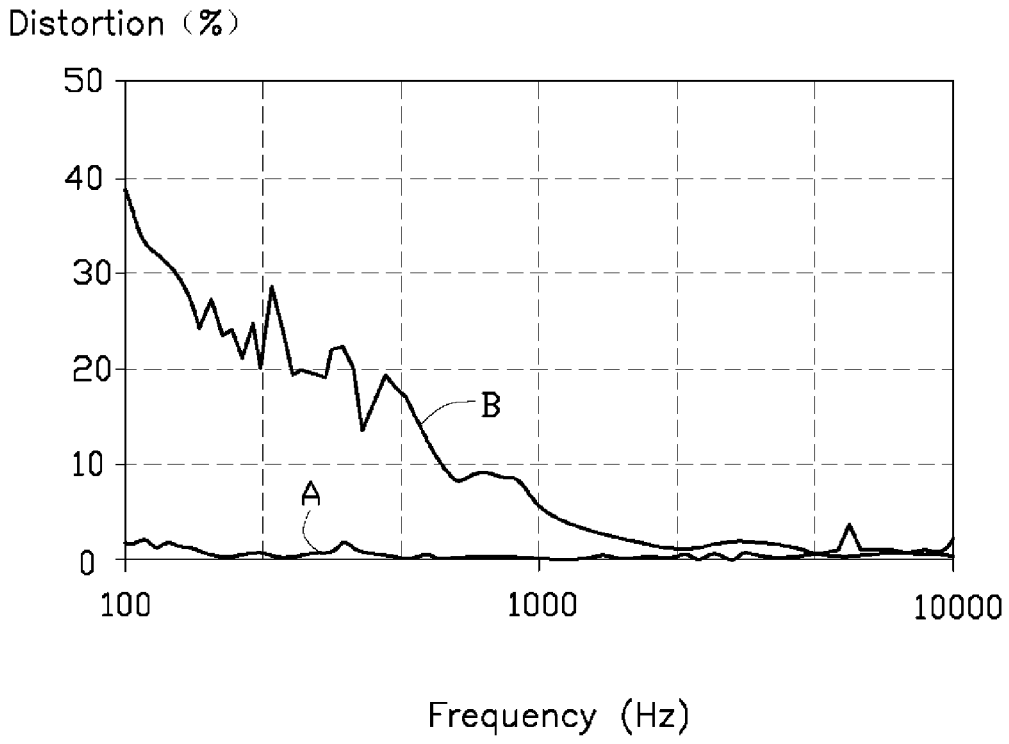
FIG. 4 is distortion diagram of the portable electronic device of FIG. 1 using the audio device of FIG. 2 to output the audio signals, according to an exemplary embodiment of the disclosure.

In addition, referring to FIGS. 3 and 4, curves A represent characteristics (i.e. frequency response and distortion) of the external speaker 210, and curves B represent the characteristics of the built-in speaker 10. According to test results shown in FIGS. 3 and 4, the external speaker 210 produces greater sound volume and higher sound quality than the built-in speaker 10.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A portable electronic device, comprising:

a built-in speaker configured to output audio signals;

an interface configured to connect to an audio device to output the audio signals;

a switch;

a main microchip detecting whether an audio device is connected to the portable electronic device; when an audio device is connected to the portable electronic device, the main microchip selecting the audio device to output the audio signals; when the audio device is not connected to the portable electronic device, the main microchip selecting the built-in speaker to output the audio signals; and an audio amplifier, wherein the audio amplifier is connected to the switch and the main microchip, the audio amplifier outputs the audio signals to the switch under the control of the main microchip.

2. The portable electronic device of claim 1, wherein the switch comprises a first common terminal, a second common terminal, a first switch terminal, a second switch terminal, a third switch terminal, and a fourth switch terminal, and a switch control terminal; the first and second common terminals are configured to receive the audio signals; the first and second switch terminals are connected to the audio device when the interface is connected to the audio device; the third and fourth switch terminals are connected to the built-in speaker; the switch control terminal is connected to the main microchip; the first and second common terminals are selectively connected to the first and second switch terminals or the third and fourth switch terminals under control of the main microchip.

3. The portable electronic device of claim 1, wherein the main microchip comprises a first control terminal, a detecting terminal, and a ground terminal; the first control terminal is connected to the switch; the detecting terminal is electrically connected to a power supply by a resistor; when the interface is connected to the audio device, the detecting terminal and the ground terminal are connected to the audio device, and the detecting terminal turns from a high voltage level to a low voltage level so that the main microchip selects the audio device.

4. An audio device, comprising:

a connector comprising a first, second, third and fourth input terminals configured to connected to a portable electronic device and a first, second, third and fourth output terminals correspondingly electronically connected to the first, second, third and fourth input terminals, the third and fourth output terminals connected to two ends of a resistor, the fourth output terminal also grounded; and an external speaker connected to the first and second output terminals to output audio signals from the portable electronic device.

5. An audio play assembly, comprising:

an audio device; and a portable electronic device, comprising:

a built-in speaker configured to output audio signals;

an interface configured to connect to the audio device to output the audio signals;

a switch;

a main microchip detecting whether the audio device is connected to the portable electronic device; when the audio device is connected to the portable electronic device, the main microchip selecting the audio device to output the audio signals; when the audio device is not connected to the portable electronic device, the main microchip selecting the built-in speaker to output the audio signals; and an audio amplifier, wherein the audio amplifier is connected to the switch and the main microchip, the audio amplifier outputs the audio signals to the switch under the control of the main microchip.

6. The audio play assembly of claim 5, wherein the switch comprises a first common terminal, a second common terminal, a first switch terminal, a second switch terminal, a third switch terminal, and a fourth switch terminal, and a switch control terminal; the first and second common terminals are configured to receive the audio signals; the first and second switch terminals are connected to the audio device when the interface is connected to the audio device; the third and fourth switch terminals are connected to the built-in speaker; the switch control terminal is connected to the main microchip; the first and second common terminals are selectively connected to the first and second switch terminals or the third and fourth switch terminals under the control of the main microchip.

7. The audio play assembly of claim 5, wherein the main microchip comprises a first control terminal, a detecting terminal, and a ground terminal; the first control terminal is connected to the switch; the detecting terminal is electrically connected to a power supply by a resistor; when the interface is connected to the audio device, the detecting terminal and the ground terminal are connected to the audio device, and the detecting terminal turns from a high voltage level to a low voltage level so that the main microchip selects the audio device.

8. The audio play assembly of claim 5, wherein the audio device comprises:

a connector, the connector comprising a first, second, third and fourth input terminals configured to connected to a portable electronic device and a first, second, third and fourth output terminals correspondingly electronically connected to the first, second, third and fourth input terminals, the third and fourth output terminals connected to two ends of a resistor, the fourth output terminal also grounded; and an external speaker connected to the first and second output terminals to output audio signals from the portable electronic device.

* * * * *